US005897085A

United States Patent [19]

Cronin

[11] Patent Number: 5,897,085

[45] Date of Patent: Apr. 27, 1999

[54] METHOD AND APPARATUS FOR ASSISTING THE DISABLED

[76] Inventor: John D. Cronin, 15 Lincoln St., Braintree, Mass. 02184-6013

[21] Appl. No.: 08/950,647

[22] Filed: Oct. 15, 1997

[51] Int. Cl.[6] ..... E04G 25/00

[52] U.S. Cl. ..... 248/200.1

[58] Field of Search ..... 248/200.1, 188.5, 248/354.7, 354.1, 351; 5/662

[56] References Cited

U.S. PATENT DOCUMENTS

| | | | |
|---|---|---|---|
| 741,541 | 10/1903 | Phipps et al. | 248/188.5 X |
| 2,490,130 | 12/1949 | Hollis | 5/81 |
| 2,541,793 | 2/1951 | Thompson | 248/354 |
| 2,594,605 | 4/1952 | Zoppelt | 248/200.1 X |
| 2,703,691 | 3/1955 | Minnis | 248/188.5 X |
| 3,027,140 | 3/1962 | Holzbach | 254/98 |
| 3,310,817 | 3/1967 | Harding | 5/92 |
| 3,479,990 | 11/1969 | Crow | 248/200.1 X |
| 3,519,293 | 7/1970 | Henning et al. | 248/200.1 X |
| 4,596,484 | 6/1986 | Nakatani | 248/188.5 X |
| 4,627,591 | 12/1986 | Heckmann | 248/188.5 X |
| 4,632,455 | 12/1986 | Schiller et al. | 297/326 |
| 4,637,654 | 1/1987 | Boardman | 297/337 |
| 4,642,824 | 2/1987 | Hodges | 5/81 R |
| 4,761,092 | 8/1988 | Nakatani | 248/188.5 X |
| 4,932,090 | 6/1990 | Johansson | 5/445 |
| 5,337,430 | 8/1994 | Schlein | 5/662 |
| 5,400,994 | 3/1995 | Shawwaf et al. | 248/354.3 |
| 5,558,501 | 9/1996 | Wang et al. | 248/200.1 X |
| 5,586,352 | 12/1996 | O'Brien et al. | 5/662 |

OTHER PUBLICATIONS

Vestil Manufacturing Company

*Primary Examiner*—Ramon O. Ramirez
*Attorney, Agent, or Firm*—Medlen & Carroll, LLP

[57] ABSTRACT

Devices and methods are described for assisting an infirm or disabled person to move about without assistance, and more particularly, a vertical support structure that can be installed temporarily without modification of ceiling, walls and floors. The device is secured by pivoting a toothed cam lever against a toothed track section. Non-slip material is fixed to the ends of the device to further stabilize it and to prevent marring of the surfaces against which the device is articulated. The devices and methods provide a simple and effective approach that does not rely on significant upper body strength and that is readily adapted to different user needs and environments.

12 Claims, 5 Drawing Sheets

METHOD AND APPARATUS FOR ASSISTING THE DISABLED

FIELD OF THE INVENTION

The invention relates to the installation and use of a device for assisting an infirm or disabled person, and more particularly, support structures that can be installed temporarily without modification of ceiling, walls and floors.

BACKGROUND

Elderly, disabled, infirm and convalescing persons often have difficulty with simple movements, such as shifting body positions, standing from a sitting position, and most importantly, getting up from supine position. Such individuals frequently need to be assisted by professionals to carry out such tasks. Facilitating secure movement in this manner prevents falls and resulting injuries. However, facilitating such movement without the need of professionals achieves the same ends, while promoting personal autonomy and decreasing the level of assistance and supervision required.

A variety of support frameworks have previously been used as support devices on hospital beds and as a means for transferring elderly, disabled, and convalescing persons into and out of bed.

Many conventional bed access devices include one or two horizontal bars that extend the length of the bed and are secured both at the head and foot ends of the bed. See e.g. U.S. Pat. No. 4,642,824 to Hodges. These overhead bars provide the patient with a handhold in order to shift himself toward the side of the bed. Such apparatus are generally satisfactory for exercise, traction and the like while the patient is on the bed. However, since the overhead bars are normally centered over the bed and spaced away from the bedside, these apparatus often do not provide sufficient assistance to the patient for getting into or out of the bed.

Although some prior assist apparatus have used an overhead cantilevered beam that extend laterally to the overhead bars, such beams have normally been used as a track for mechanical lifting devices. See e.g. U.S. Pat. No. 2,490,130 to Hollis. These devices actually hoist the patient out of the bed and carry the patient to the bedside. Such devices unfortunately depend on significant gripping capability and upper body strength.

A further limitation on prior art designs comes from the fact that these devices are typically designed for hospital use and therefore are not easily adaptable to other settings, including but not limited to private domestic settings. That is to say, such support structures are designed to be permanently installed with extensive modification of ceiling, walls and/or floors.

What is needed is a simple, effective method of assisting disabled individuals that does not rely on significant upper body strength and that is readily adapted to different user needs and environments.

SUMMARY OF THE INVENTION

The invention relates to the installation and use of a device for assisting an infirm or disabled person. As noted above, prior art designs are typically designed to be permanently installed with extensive modification of ceiling, walls and/or floors. The present invention solves these problems by providing an adaptable, portable device for facilitating a whole body attempt rise from a variety of platforms. The support structure can be installed temporarily without modification of ceiling, walls and floors. Furthermore, the apparatus is a passive structure that an individual with impaired mobility can use to move onto and off of a variety of platforms without the use of supplemental mechanical assistance.

In one embodiment, the present invention contemplates a device comprising an expanding pole (i.e. a pole capable of being extended in length) composed of at least two sections (although more sections are possible, including but not limited to sections that are hinged together), the sections being capped on either end with plates partially or entirely covered with a non-slip layer of material. Such a pole can be quickly installed next to a given platform (such as a chair, bed, bath tub or toilet) through the extension of the poles via a compression means such that sufficient compressive force is developed between the capped ends and the floor and ceiling.

In one embodiment, the present invention contemplates a portable device, comprising an upper section slidingly engaged within a lower section and a compression means, said upper section having an upper end and said lower section having a lower end, said lower end comprising a first lower disk and said upper end comprising a first upper disk, said first lower and upper disks having outer surfaces (the outer surfaces contact the floor and ceiling, respectively).

The present invention also contemplates methods of installing and removing the device. In one embodiment, the method of installing a device comprises a) providing i) a portable device, said portable device comprising an upper section slidingly engaged within a lower section (e.g. with the bore of the lower section) and a compression means, said upper section having an outer surface, inner surface and an upper end and said lower section having an outer surface, inner surface and a lower end, said lower end comprising a first lower disk and said upper end comprising a first upper disk, said first lower and upper disks having outer surfaces; ii) first and second structural surfaces separated by a space (such as a ceiling and floor of a room); b) positioning said portable device between said first and second structural surfaces by sliding said upper section of said device so as to fill said space between said first and second structural surfaces and so as to contact said first structural surface with said first lower disk and said second structural surface with said first upper disk; and c) securing said portable device against said first and second structural surfaces via said compression means to create an installed device, under conditions such that said installed device will not be displaced by manually applied lateral forces.

It is not intended that the present invention be limited by the type of compression means. A variety of compression means are contemplated. In one embodiment, the compression means comprises one or more hinges linking the sections together; in this embodiment, the pole is extended by pivoting additional sections into place that are dimensioned such that the pole is slightly higher (typically between one-eighth inch and one-half inch) than the ceiling, causing the pole to press against the ceiling. In one embodiment, the compression means comprises a ratcheted extension established by the interaction of a linear gear set into the upper tubular section and a geared locking cam with a handle designed to fit into the linear gear in the upper member.

It is also not intended that the present invention be limited by the dimensions (height, width, etc.) or configurations (square, tubular, pivoting, etc.) of the two sections. In a preferred embodiment, the sections are dimensioned for normal room heights (and normal hand grips) and configured as tubular sections that are capable of sliding over one another, such as a telescoping assembly having an upper tube slidingly engaged within the bore of a lower tube. As noted above, the sections are capped on either ends with plates or disks (preferably, the disks are welded to the sections; alternatively they are reversibly inserted). It is contemplated that one side of the plates or disks are contacted with the non slip material.

It is also not intended that the present invention be limited by the nature of the material used as a non-slip layer. A variety of materials are contemplated, including but not limited to, polymer coatings. While glues can be used, preferred materials are those that permit quick installation and removal, such as rubber, including foam rubber. By using a non-slip material, it is the intention of the present invention to avoid permanent attachment means, such as bolts and screws and the like, which cause modification of ceilings, walls and/or floors (i.e. by putting in unsightly holes). By avoiding permanent attachment means, the device is portable.

In one embodiment, the present invention contemplates a pair of installed poles could be horizontally spanned by a crossbar so as to straddle a given platform (such as a bed). Such a configuration allows a person to pull himself upright while in a prone position. Since the apparatus is a free standing structure, the apparatus is adapted to serve different sized platforms (such as a wide variety of beds).

In another embodiment, the present invention contemplates a combination with chairs and beds having other assistance features, including beds and chairs with powered lift components. For example, the present invention contemplates combining the portable device with a chair having a moveable seat, i.e. such as one that is able to be moved towards the device. Such a seat might be raised, lowered and/or tilted to facilitate getting the person in a rise position such that their upper body need do even less work as disclosed in U.S. Pat. No. 4,637,654 to Boardman and U.S. Pat. No. 4,632,455 to Schiller hereby incorporated by reference.

In yet another embodiment the apparatus is designed to provide a stable attachment point for accessories such as shelves, tables, trays, and hooks for containers of intravenous fluids as well as for patient monitoring equipment, such equipment including but not limited to cardiac and respiratory monitoring equipment.

Importantly, the present invention provides an apparatus that can be used in a variety of settings including (but not limited to) hotels, motels, inns, cottages, hospitals, nursing homes, hospices, and private homes.

DEFINITIONS

Figure 1:
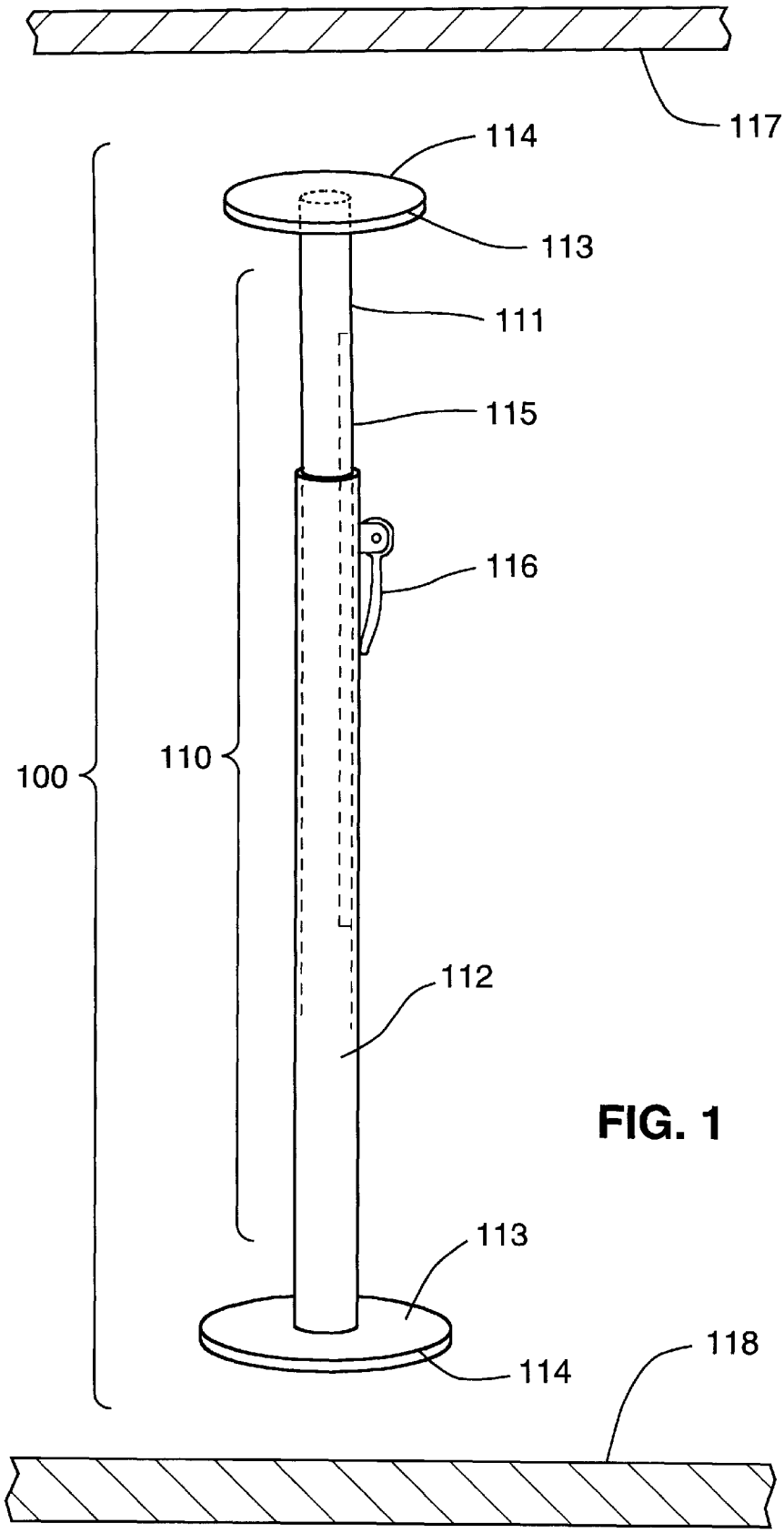
FIG. 1 is a perspective view of one embodiment of the apparatus according to the invention.

The term "slidingly engaged" is intended to describe the interaction between two or more components whereby said components move reciprocally with regard to each other along a linear (or approximately linear) axis.

The term "compression means" is intended to encompass any means for moving the sections of the device away from each other so as to expand the length of the device to allow for compression against a floor and ceiling, ceiling and wall, or wall and floor. In one embodiment, the device of the present invention comprises two pieces or sections which are manually extended to fill the space between a floor and ceiling, i.e. until the ends of the device are touching the floor and ceiling. While the device is thereby positioned, in order to fit the device snugly and securely against the floor and ceiling, the present invention contemplates a compression means. Specifically, once the two sections of the device have been expanded manually, the compression means allows for a final expansion (of typically between approximately one-eighth inch and one-half inch, although larger expansions are possible where the ceiling or floor compresses to a greater degree) which presses the device against the floor and ceiling in a manner such that it will not be displaced by manually applied lateral forces (such as those imparted by a moving disabled person).

In one embodiment, the compression means comprises a track that is geared, i.e. that has either indentations or teeth to engage a cam (a part designed for rotary motion so as to cause a rocking or reciprocating motion to a contiguous part) having either teeth or indentations. In a preferred embodiment, the track is linear and has indentations, while the cam interacts via teeth.

The term "non-slip material" is intended to encompass any material that causes the caps of the device to be secure against a ceiling, wall or floor (e.g., foam rubber, etc.). Thus, the material is defined functionally and such materials can be readily tested by applying pressure to an installed device and checking for movement.

The term "structural surfaces" are surfaces of structures such as a room of a house. Such structures include but are not limited to ceilings, floors and walls.

The term "infirm or disabled" is intended to encompass patients suffering from musculoskeletal, neurological, cardiopulmonary or deconditioned impairments.

The term "disengageably articulated" is intended to describe the interaction between two or more components whereby receiving areas or structures receive or nest the projections extending from the surface of another component to produce a reversible union of said two or more components which are stabilized against the application of lateral forces. In this regard, the present invention contemplates disks that are disengageably articulated.

The term "receiving areas or receiving structures" is intended to include indentations having geometries including,, but not be limited to, cylindrical indentations, hexagonal indentations, and slots.

The term "projection" is intended to describe geometric shapes including, but not limited to, cylindrical pins, hexagonal pins, and rectangular bars. The present invention contemplates that the projections of a second disk (regardless of their geometry or shape) will fit into corresponding receiving structures of a first disk.

The term "low tack adhesive" is intended to describe stickiness sufficient secure a plurality of element by some slight or temporary fastening.

DESCRIPTION OF THE PREFERRED EMBODIMENTS

One embodiment of the portable support device apparatus is shown in FIG. 1 and referenced generally by the numeral 100. The apparatus includes a telescoping assembly 110, having an upper section 111 slidingly engaged within the bore of a lower section 112, upper and lower ends of this assembly comprising disks 113, these disks are contacted with non-slip material 114. Preferably, the sections are engaged such that one will readily slide over the other (although FIG. 1 shows the top section sliding within the bottom section, embodiments are contemplated where the top section slides over the bottom section; the latter embodiment requires certain adjustments to the other features for proper operation) when using manual force.

For the final expansion to cause compression against surfaces and to secure a proper installation, the device comprises a compression means. In one embodiment, the compression means comprises a track which interacts with a lockable cam. In the embodiment shown in FIG. 1, the outer surface of the upper tube is linearly geared along a vertical track 115, wherein a lockable cam 116 is pivotally engaged with said linear geared track to facilitate a ratcheted expansion of said telescoping assembly, such that sufficient compressive force is developed between floor 118 and ceiling 117 to fix said device in place.

Figure 2:
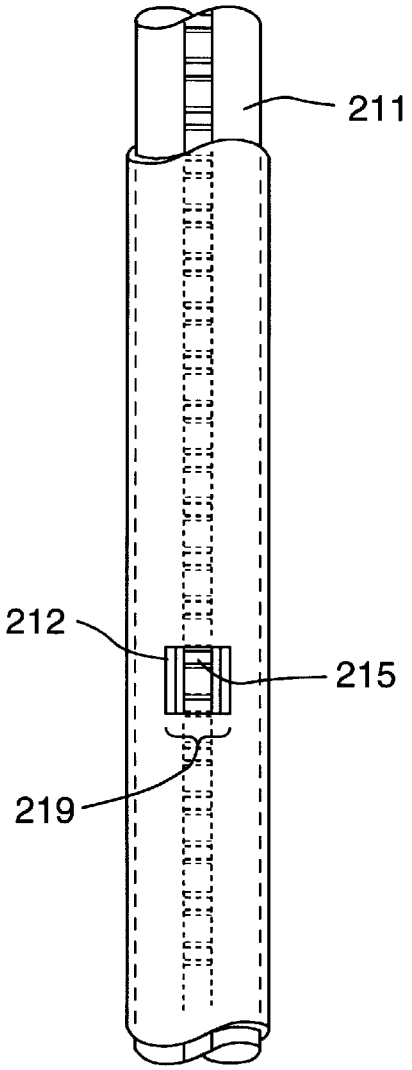
FIG. 2 is an expand view of the linear gear track associated with one embodiment of the invention.

FIG. 2 is an expanded view of a portion of the apparatus presented in FIG. 1, with the exception of the features noted below. Similar elements have therefore been given complementary reference numerals with a 200 prefix. Shown in greater detail in FIG. 2 is a window 219 communicating between the surface of the linearly geared track 215 associated with the upper section 211 and the exterior of the lower tube 212.

Figure 3:
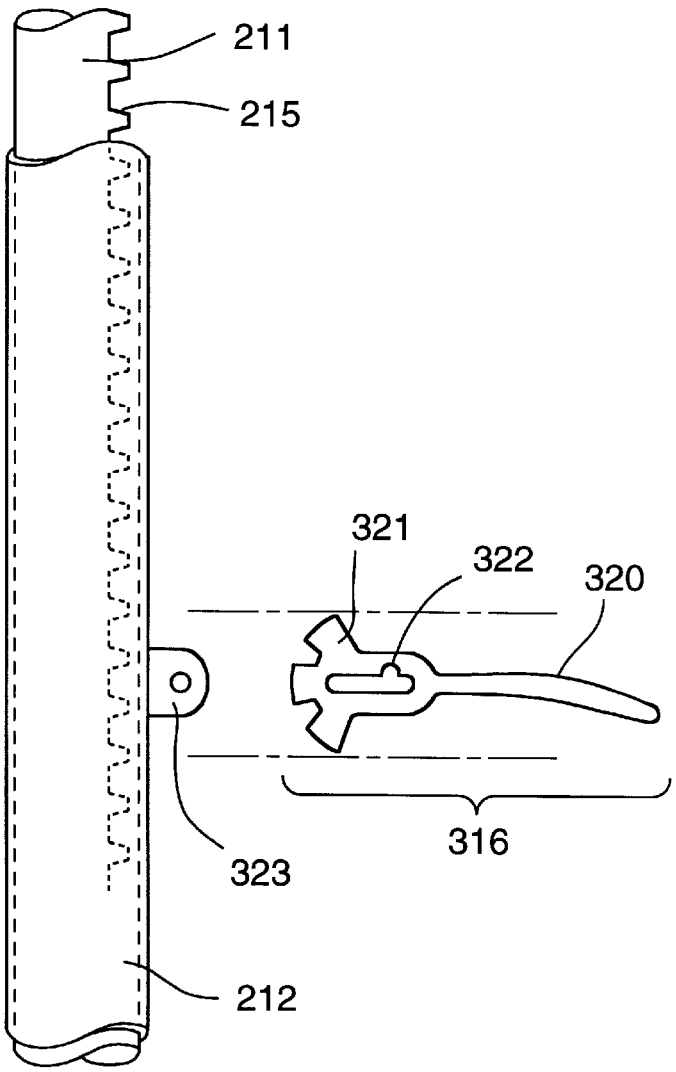
FIG. 3 is an expanded view of the interaction between the locking cam and the linear gear track of one embodiment of the apparatus of the present invention..

FIG. 3 is a different expanded view of a portion of the apparatus presented in FIG. 1, with the exception of the features noted below. Similar elements have therefore been given complementary reference numerals with a 300 prefix. Shown in greater detail, in FIG. 3, is the interaction between the lockable cam 316 (comprising a tapered end 320 and a geared end 321, said tapered end and said geared end oriented around a pivot point 322 contacting a pair of brackets 323 fixed on either side of the window 219 depicted in FIG. 2.) and the portion of linearly geared track 215 exposed through the window 219 depicted in FIG. 2.

Figure 4:
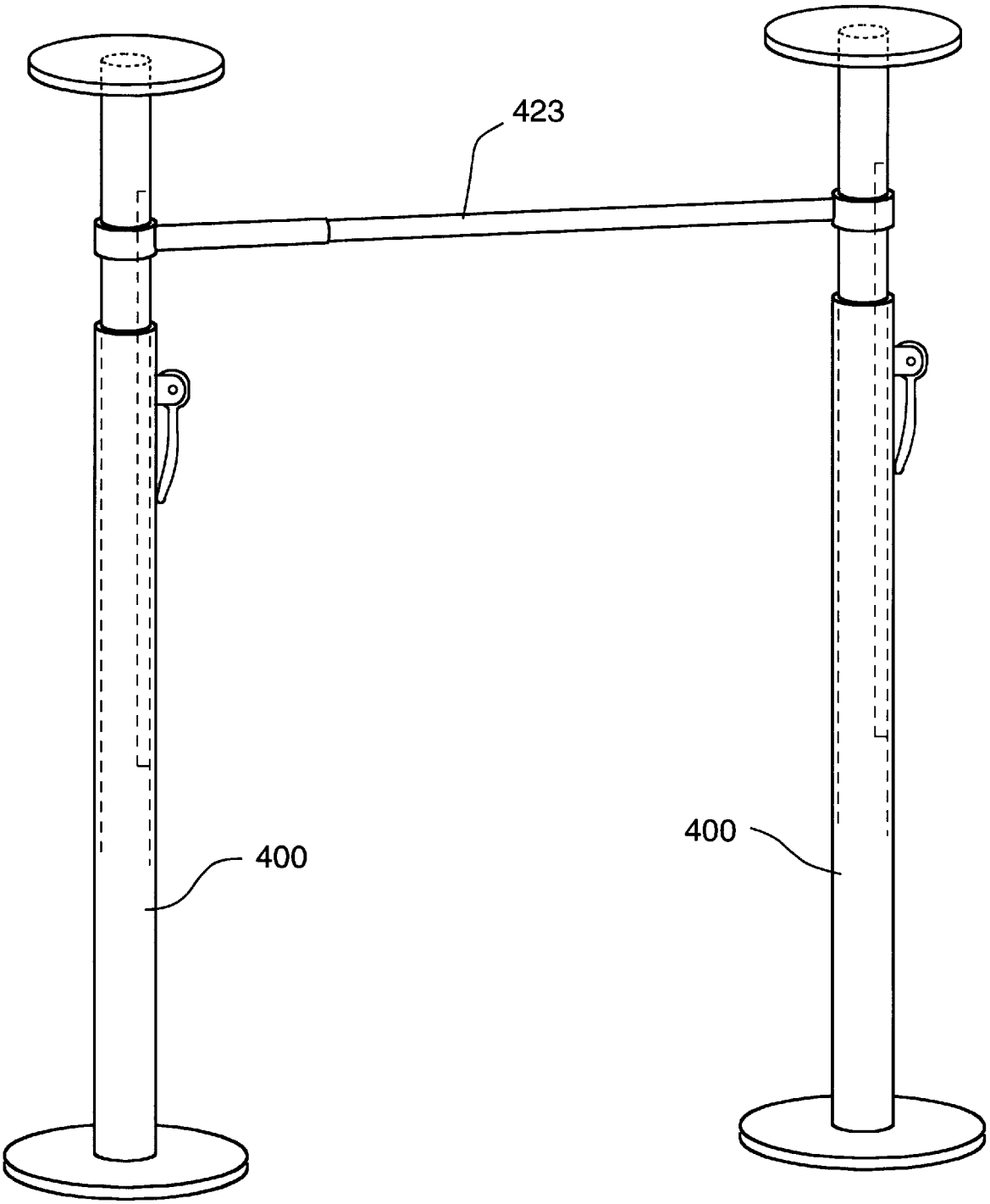
FIG. 4 is an expanded view pair of an embodiment of the present invention that is connected by a horizontal spanning bar.

The apparatus shown in FIG. 4 is identical to the apparatus presented in FIG. 1, with the exception of the features noted below. Similar elements have therefore been given complementary reference numerals with a 400 prefix. The apparatus presented in FIG. 4. comprise a pair of portable support devices 400 joined or spanned by a variable length (e.g. telescoping) bar 423.

Figure 5:
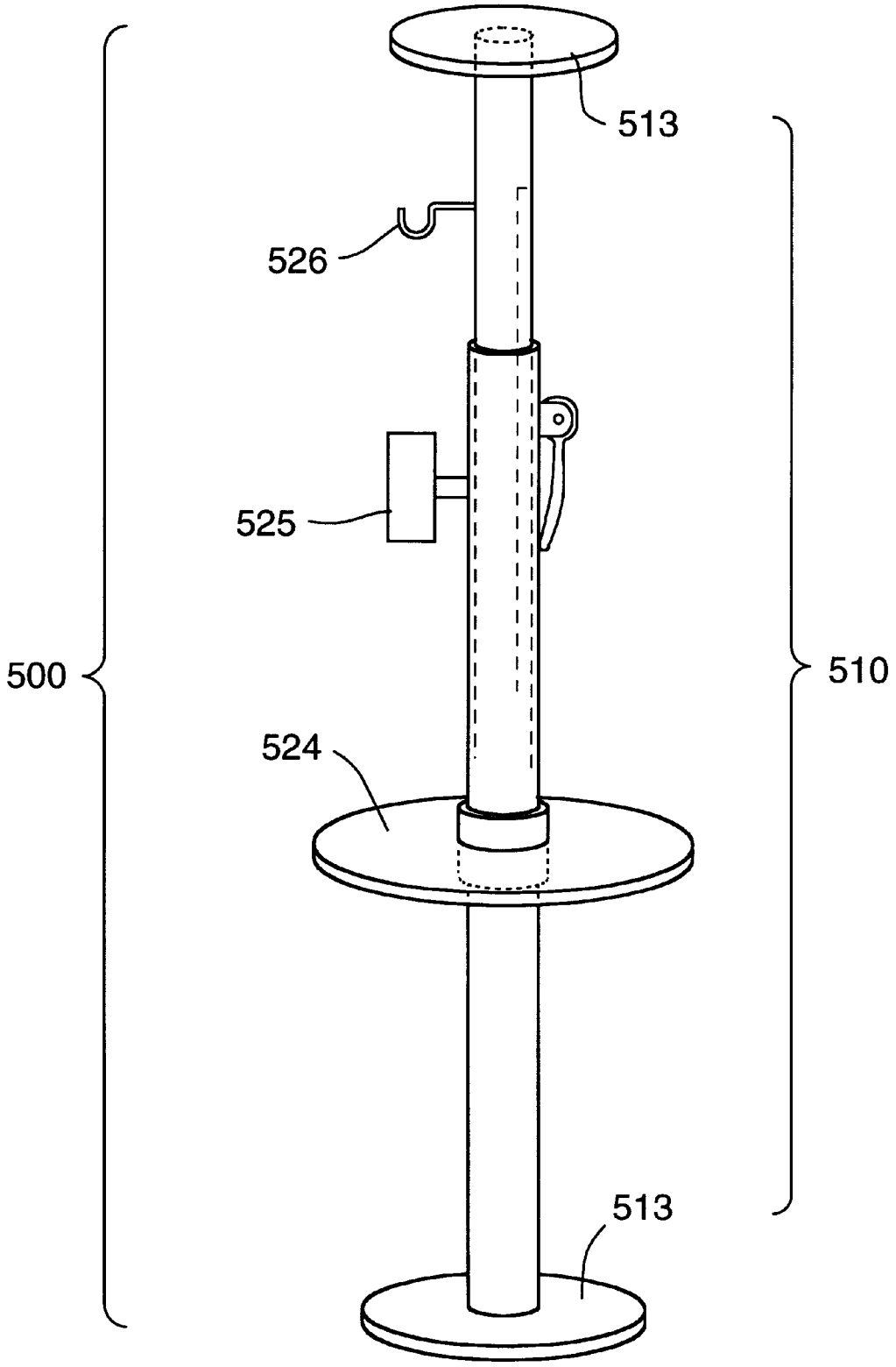
FIG. 5 shows one embodiment of the invention utilizing the apparatus with accessories.

The apparatus 500 shown in FIG. 5 is identical to the apparatus presented in FIG. 1, with the exception of the features noted below. Similar elements have therefore been given complementary reference numerals with a 500 prefix. The apparatus presented in FIG. 5 is a platform for fixable accessory devices which may be attached any place along the telescoping assembly 510 or affixed to disks 513 contacting the ends of the telescoping assembly. Examples of such fixable accessories include (but are not limited to) a table 524, a medical monitoring device 525 and attachment hardware 526 for suspending intravenous solutions.

In another embodiment it is contemplated that the first disk comprising the end of the upper section of said portable assisting device may be disengageably articulated with a second disk of greater diameter. Such disengageable articulation is effected by providing receiving areas or structures of a given depth (made by any of a variety of techniques, including but not limited to machining or casting) into the surface of said first disk comprising the end of said upper section of said portable assisting device. Such receiving areas or structures are capable of nesting projections extending from the bottom of said second disk of greater diameter. The geometry of projections extending from the bottom surface of said second disk of greater diameter include, but are not limited to, cylindrical pins, hexagonal pins, and rectangular bars. It is contemplated that the diameter of said first disk falls within the range of 12 to 18 inches, the most preferable diameter being 16 inches (being the typical distance between ceiling beams). However, it should be noted that the diameter of the disk associated with said lower section may be preferably reduced below 12 inches, so as to prevent the base of said device from becoming a tripping hazard. It is contemplated that the diameter of the second disk will be larger than 16 inches, more specifically 18 to 30 inches (so as to distribute the loads generated by installing said device across the weight bearing elements of said ceiling, i.e. beams).

It is further contemplated that a non-slip surface may be provided directly to the disks comprising the ends of said device. In the alternative, said non-slip surface may be applied to the second disks. In some embodiments, the non-slip material is supplied to the end user for application (e.g. peel-back tape, or a low tack adhesive that is contacted with the outer surface of said first or second disks such that no significant residue remains on the outer surface of said disks when said adhesively affixed non-slip material is removed); such applied material can be, in some embodiments, removed from the first disk and applied to the second disk.

Figure 6:
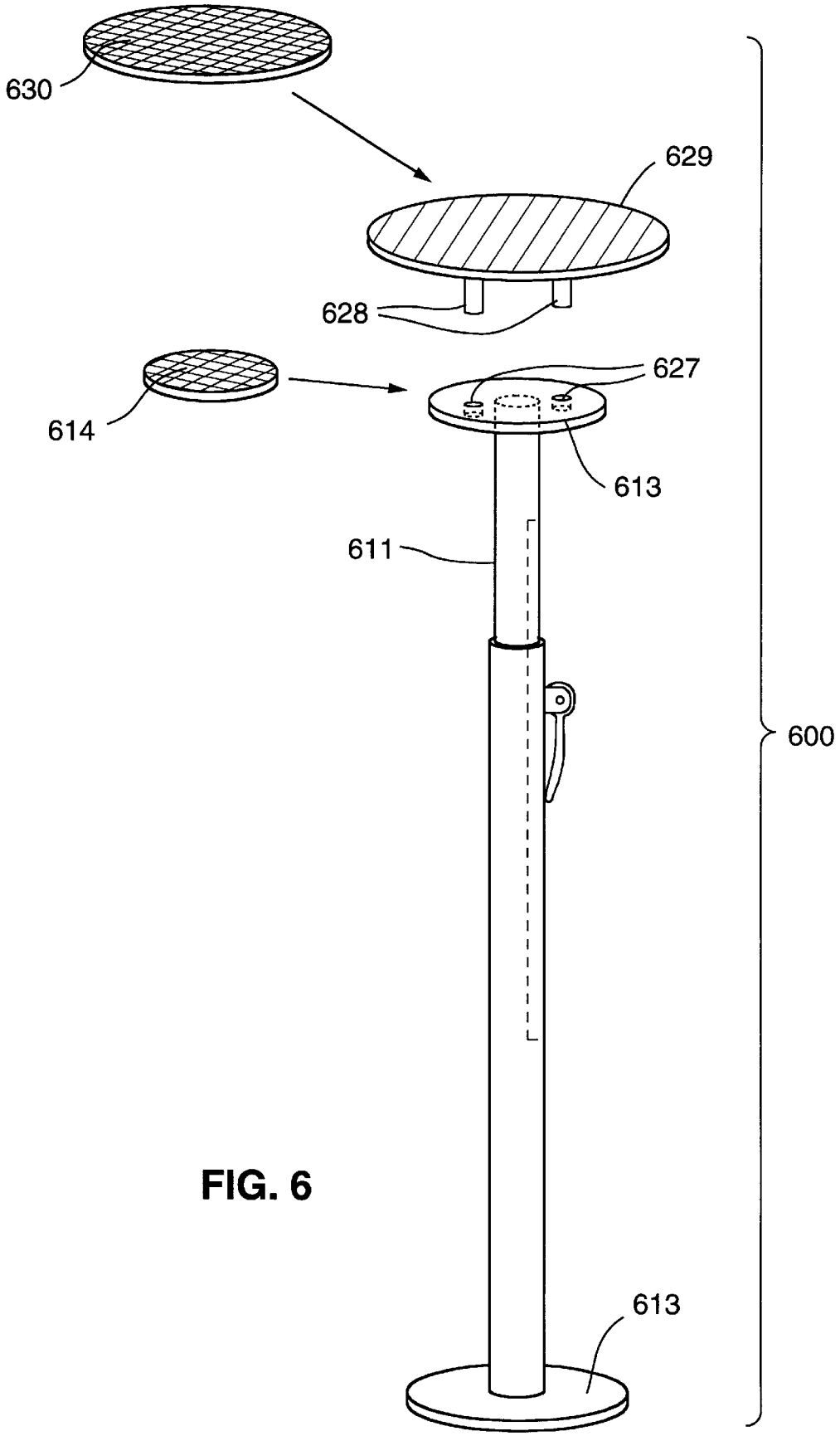
FIG. 6 shows one embodiment of the invention with a second disk interacting with the first disk attached at the upper end of the device.

The apparatus shown in FIG. 6 is identical to the apparatus presented in FIG. 1, with the exception of the features noted below. Similar elements have therefore been given complementary reference numerals with a 600 prefix. The apparatus presented in FIG. 6 is a portable support device 600 with an upper end and a lower end said ends comprising first disks 613, said first disks having receiving areas 627 of a given depth, bored or cast into the surface of said first disk capable of receiving or nesting the projections 628 extending from the bottom of said second disk 629 of greater diameter. It is contemplated that the diameter of said second disks measure within the range of 18–25 inches. It is further contemplated that a non-slip 614 material may be applied directly to the surface of said first disk said non-slip layer of said first disk may be removed and similar non-slip material 630 applied to any portion of the upper surface of said second disk 629 thereby revealing the receiving areas of said first disk such that said disks may be reversibly joined.

From the above description and examples, it is clear that the present invention contemplates devices and methods for a simple and effective way to assist infirm and disabled people. By avoiding permanent attachment means, the device is readily installed and removed without damage to ceilings and floors. Removal is achieved by reversing the steps of installation (see above), e.g. releasing the compression means and manually collapsing the sections. Such a portable device can be installed during a period of convalescence and thereafter removed. Similarly, such a portable device can be installed for a particular patient (or hotel guest, etc.) and thereafter removed at the appropriate time.

I claim:

1. A portable device, comprising an upper section slidingly engaged within a lower section and a means for moving said sections of said device away from each other, said upper section having an outer surface, inner surface and an upper end and said lower section having an outer surface, inner surface and a lower end, said lower end comprising a first lower disk and said upper end comprising a first upper disk, said first lower and upper disks having outer surfaces, wherein said means for moving said sections comprises a geared track.

2. The device of claim 1, wherein said track is positioned on the outer surface of said upper tube.

3. The device of claim 2, wherein said means for moving said sections further comprises a window extended from the outer surface to the inner surface of said lower tube.

4. The device of claim 3, wherein said means for moving said sections further comprises a cam, said cam comprising a handle and geared end, said geared end pivotally engaged through said window of said lower tube with said geared track of said upper tube.

5. A method of installing a device, comprising:

a) providing:

i. a portable device, comprising an upper section slidingly engaged within a lower section and a means for moving said sections of said device away from each other, said upper section having an outer surface, inner surface and an upper end and said lower section having an outer surface, inner surface and a lower end, said lower end comprising a first lower disk and said upper end comprising a first upper disk, said first lower and upper disks having outer surfaces, ii. first and second structural surfaces separated by a space and iii. a second upper disk having a greater diameter than said first upper disk;

b) attaching said second upper disk to said first upper disk;

c) positioning said portable device between said first and second structural surfaces by sliding said upper section of said device so as to fill said space between said first and second structural surfaces and so as to contact said first structural surface with said first lower disk and said second structural surface with said second upper disk; and d) securing said portable device against said first and second structural surfaces via said means for moving said sections to create an installed device, under conditions such that said installed device will not be displaced by manually applied lateral forces.

6. The method of claim 5, wherein said first disks are disengageably articulated with second disks of greater diameter, said second disks having outer surfaces.

7. The method of claim 5, wherein said outer surfaces of said second disk comprises non-slip material.

8. The method of claim 5, wherein said means for moving said sections comprises a geared track.

9. The method of claim 8, wherein said track is positioned on the outer surface of said upper tube.

10. The method of claim 9, wherein said means for moving said sections further comprises a window extended from the outer surface to the inner surface of said lower tube.

11. The method of claim 10, wherein said means for moving said sections further comprises a cam, said cam comprising a handle and a geared end, said geared end pivotally engaged through said window of said lower tube with said geared track of said upper tube.

12. A portable device, comprising an upper section slidingly engaged within a lower section and a means for moving said sections of said device away from each other, said means comprising a geared track, a window extended from the outer surface to the inner surface of said lower tube, and a cam, said cam comprising a handle and geared end, said geared end pivotally engaged through said window of said lower tube with said geared track of said upper tube, said upper section of said device having an outer surface, inner surface and an upper end and said lower section of said device having an outer surface, inner surface and a lower end, said lower end comprising a first lower disk and said upper end comprising a first upper disk, said first lower and upper disks having outer surfaces.

* * * * *